US006242048B1

(12) United States Patent
Iida et al.

(10) Patent No.: US 6,242,048 B1
(45) Date of Patent: Jun. 5, 2001

(54) METHOD OF MANUFACTURING HOT DIP COATED METAL STRIP

(75) Inventors: Sachihiro Iida; Takahiro Sugano, both of Tokyo (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/597,560

(22) Filed: Jun. 20, 2000

(30) Foreign Application Priority Data

Jun. 24, 1999 (JP) ..... 11-177732

(51) Int. Cl.[7] ..... B05D 1/18; B05D 3/04; B05D 3/02

(52) U.S. Cl. ..... 427/433; 427/349; 427/383.7; 427/431; 427/434.2; 427/434.4; 427/436; 242/615.2

(58) Field of Search ..... 427/349, 383.7, 427/431, 433, 434.2, 434.4, 436; 226/189; 242/615.2

(56) References Cited

U.S. PATENT DOCUMENTS 4,673,447 * 6/1987 Sakai et al. ..... 148/156
5,634,977 * 6/1997 Ookouchi et al. ..... 118/423

FOREIGN PATENT DOCUMENTS 9-202955 * 8/1997 (JP) .

* cited by examiner

*Primary Examiner*—Shrive Beck
*Assistant Examiner*—Michael Barr
(74) *Attorney, Agent, or Firm*—Young & Thompson

(57) ABSTRACT

A molten metal is deposited on the surfaces of a metal strip by continuously dipping the metal strip in a coating bath. The metal strip is lifted at a constant speed while supported with a pair of upper and lower support rolls in the coating bath. The coating weights of the molten metal deposited on the surfaces of the metal strip are adjusted by wiping the molten metal with gases from gas wiping nozzles disposed above the surface of the coating bath. The metal strip is advanced while supported with a pair of upper and lower touch rolls, wherein the metal strip is advanced by setting the distance L between the upper support roll disposed in the coating bath and the lower touch roll disposed outside the coating bath within the range determined by a formula $L \leqq 80 \times T \times W^2/V$, where L: distance between the upper support roll in the coating bath and the lower touch roll outside the coating bath (mm), V: line speed of the metal strip (m/min), T: tension imposed on the metal strip (kgf/mm$^2$), and W: target coating weight per one side of the metal strip (g/m$^2$). The stable quality of the metal strip can be obtained by reducing the variation of the coating weights of the molten metal deposited on the surfaces of the metal strip at all times regardless of the change of the operating conditions under which continuous hot dip galvanizing operation is carried out. Further, a coating cost can be greatly reduced by preventing the excessive deposition of the molten metal.

6 Claims, 7 Drawing Sheets

METHOD OF MANUFACTURING HOT DIP COATED METAL STRIP

BACKGROUND OF THE INVENTION

1. Field of the Invention

The present invention relates to a method of manufacturing a hot dip coated metal strip. More particularly, the present invention relates to a method of manufacturing a hot dip coated metal strip having a coating layer of a uniform thickness by reducing the vibration of the metal strip which is lifted from a hot dip coating bath and travels vertically at an approximately constant speed.

2. Description of the Related Art

In general, hot dip galvanizing is applied to the surfaces of a steel strip using a continuous hot dip galvanizing apparatus (also referred to as a line) as described below.

First, as shown in FIG. 2, a steel strip 1 as a material to be coated is introduced into a hot dip galvanizing bath 2, the direction of travel of the steel strip 1 is diverted upward by a sink roll 3 disposed in the galvanizing bath 2, the crossbow of the steel strip 1 is corrected by a pair of upper and lower support rolls 4 disposed in the galvanizing bath 2 so as to clamp both the surfaces of the steel strip 1, and then the steel strip 1 is lifted vertically from the galvanizing bath 2. During that time, molten zinc is deposited on the surfaces of the steel strip 1. A gas 6 (referred to as a wiping gas) is blown onto the surfaces of the steel strip 1, on which the molten zinc has been deposited and which travels upward, through nozzles 5 (referred to as wiping nozzles because they wipe off the coated metal) so that the amount of the molten metal deposited on the steel strip 1 is adjusted to a desired amount (so that the molten metal can be uniformly deposited on the entire surface of the steel strip 1). A pair of touch rolls 7, which clamp the surfaces of the steel strip 1 similarly to the support rolls 4, are disposed above the wiping nozzles 5 to stabilize the travel of the steel strip 1. The steel strip 1, which has passed through the touch rolls 7, may be subjected to an alloying treatment by travelling through an alloying furnace 8 disposed above the touch rolls 7 so that the coating layer thereof is alloyed when necessary.

By the way, recently, it has become very important to stably manufacture at high speed a hot dip galvanized steel strip which has a low coating weight (referred to as light coating). In accordance with the reduced coating weight, there has been required a technology for manufacturing a hot dip galvanized steel strip while preventing the vibration thereof due to an increase in the pressure of the wiping gas 6, and the like. This is because the coating weight of the molten zinc deposited on the surfaces of the steel strip is greatly varied by an increase in the vibration of the steel strip and the quality of a product is thereby deteriorated.

Ordinarily, when the hot dip coated steel strip 1, which has a particularly low coating weight (coating weight per one side is 45 $g/m^2$ or less), is manufactured at a high speed, the steel strip 1 is vibrated at the position where the wiping nozzles 5 are disposed in a direction vertical to the surfaces thereof in a total amplitude of vibration of 1–2 mm at all times.

Since wiping cannot be smoothly carried out when this vibration occurs, at present, the standard deviation of the variation of the coating weights on the surfaces of a steel strip $\sigma$ is set to a large value of 2–4 $g/m^2$ ($\sigma$=2–4 $g/m^2$) with respect to the coating weight per one side of 45 $g/m^2$. However, since it is generally required by customers to guarantee the lower limit of the coating weight, when the guarantee for the lower limit is kept, molten zinc is excessively deposited. This means that a large amount of zinc is wastefully consumed from the view point of manufacturers.

When a hot dip galvannealed steel strip is manufactured, the large variation of the coating weight directly leads to the variation of the coating weight of hot dip galvannealing. Thus, when the steel strip 1 is manufactured, the coating is often undesirably exfoliated in a powder state (referred to as powdering) from a portion of the steel strip 1 where zinc is thickly deposited; moreover, a defect such as uneven alloying, and the like is liable to occur in the manufacture of the steel strip 1.

Technologies for preventing the vibration have been vigorously developed and many of them have been published. For example, Japanese Unexamined Patent Application Publications Nos. 5-320847 and 5-078806 disclose technologies for disposing a static pressure pad to maintain the pressure of a gas which is blown to wiping nozzles at a constant pressure. Further, Japanese Unexamined Patent Application Publication No. 6-322503 discloses a technology for separately disposing nozzles for blowing a shield gas above wiping nozzles and disposing gas shield plates between the shield gas blowing nozzles and the wiping nozzles.

However, the technologies for preventing the vibration of a steel strip by means of the static pressure pad or by blowing another gas are not in practical use because high power must be specially provided to generate a desired pressure and flow rate of gas as well as the effect of the technologies is lowered when the steel strip has a relatively large thickness.

Further, Japanese Unexamined Patent Application Publications Nos. 52-113330, 6-179956 and 6-287736 disclose technologies for preventing the vibration of a steel strip using magnetic force or electromagnetic force. However, these technologies are not yet in practical use because not only do they separately require an expensive magnetic force generator and operation is made complex but also the effect of the technologies is lowered in a steel strip having a relatively large thickness.

SUMMARY OF THE INVENTION

In view of the above circumstances, an object of the present invention is to provide a method of manufacturing a hot dip coated metal strip which can provide the metal strip with stable quality by reducing the variation of the coating weight of molten metal to be deposited on the surfaces of the metal strip even if operating conditions of hot dip coating are changed as well as which can greatly lower a coating cost by preventing the excessive deposition of the molten metal.

To achieve the above object, the inventors examined the influences of tension of a traveling metal strip, target coating weight, linear speed of the metal strip, pressure of a wiping gas, distance between a touch roll disposed above wiping nozzles and a support roll disposed in a bath, and the like on the vibration of the metal strip at a gas wiping position in many test operations. Then, the inventors have completed the present invention based on a knowledge discovered from the analysis of data obtained in the examination that the vibration of a metal strip can be greatly reduced when operation is carried out by setting the distance between the touch roll and the support roll disposed in the bath within a certain range.

That is, according to the present invention, there is provided a method of manufacturing a hot dip coated metal strip which includes the steps of depositing molten metal on the surfaces of the metal strip by continuously dipping the metal strip in a hot dip coating bath, lifting the metal strip at a constant speed while supporting it with a pair of upper and lower support rolls for clamping the surfaces of the metal strip in the coating bath, adjusting the coating weights of the molten metal deposited on the surfaces of the metal strip by wiping the molten metal with gases from gas wiping nozzles disposed above the surface of the coating bath, and advancing the metal strip while supporting it with a pair of upper and lower touch rolls disposed outside the coating bath for clamping the surfaces thereof, wherein the metal strip is advanced by setting the distance L between the upper support roll disposed in the coating bath and the lower touch roll disposed outside the coating bath within the range determined by the following formula:

$$L \leqq 80 \times T \times W^2/V$$

in which,

L: distance between the upper support roll in the coating bath and the lower touch roll outside the coating bath (mm);

V: linear speed of the metal strip (m/min);

T: tension imposed on the metal strip (kgf/mm$^2$); and

W: target coating weight per one side of the metal strip (g/m$^2$)

Furthermore, according to the present invention, it is preferable that the metal strip be composed of a steel strip and that the molten metal coating solution in the hot dip coating bath be molten zinc. Still further, it is preferable that the metal strip be subjected to an alloying treatment downstream of the upper touch roll.

According to the present invention, the total amplitude of vibration of the metal strip having the molten metal deposited on the surfaces thereof is greatly reduced at gas wiping positions as compared with a conventional total amplitude of vibration, and coating weights can be smoothly and ideally adjusted. As a result, a metal strip having molten metal deposited on all surfaces thereof can be stably manufactured with a uniform coating weight.

DESCRIPTION OF PREFERRED EMBODIMENTS

Figure 1:
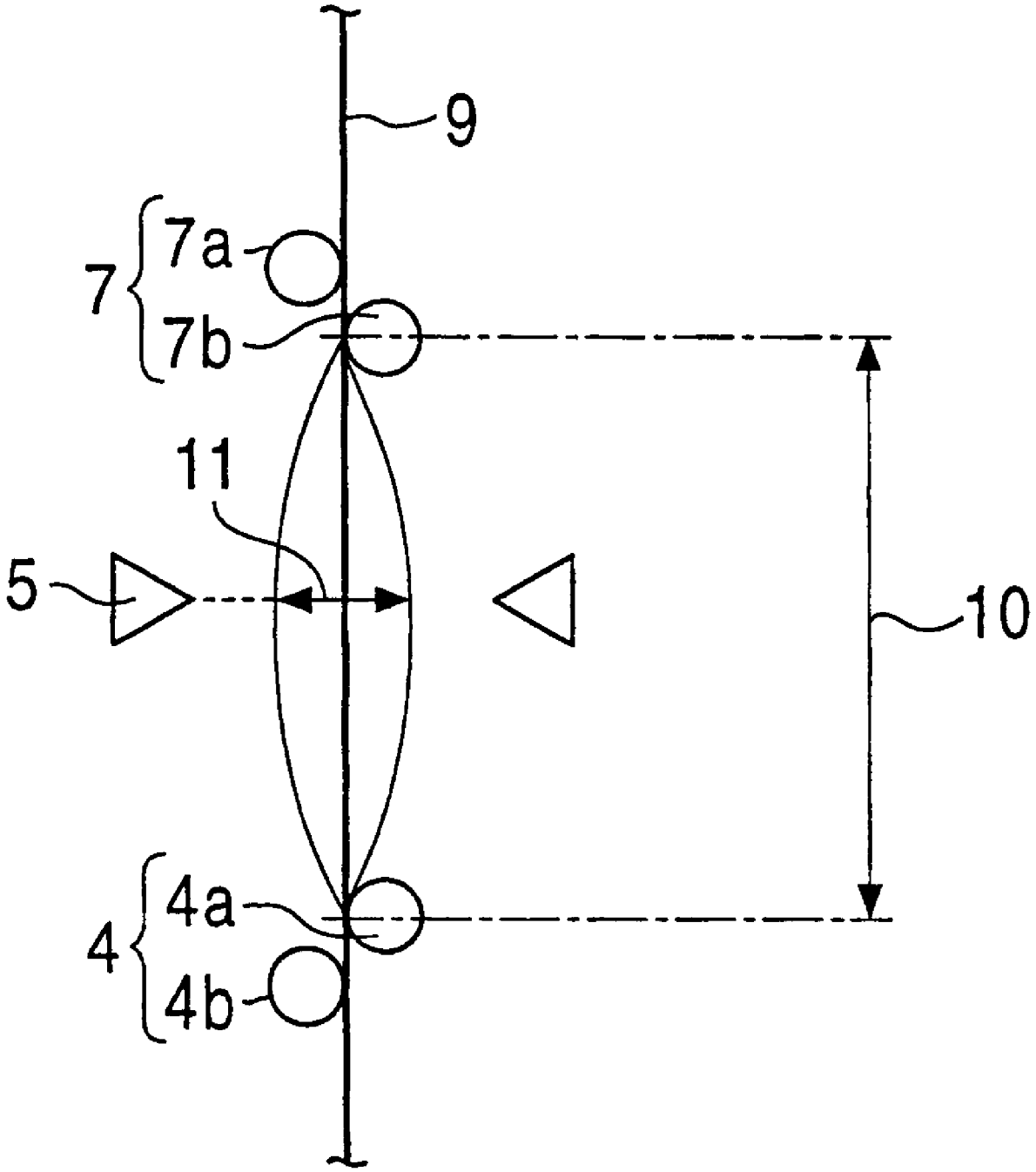
FIG. 1 is a view showing how support rolls and touch rolls are disposed within and outside a bath, respectively, and how a steel strip is vibrated.
Figure 2:
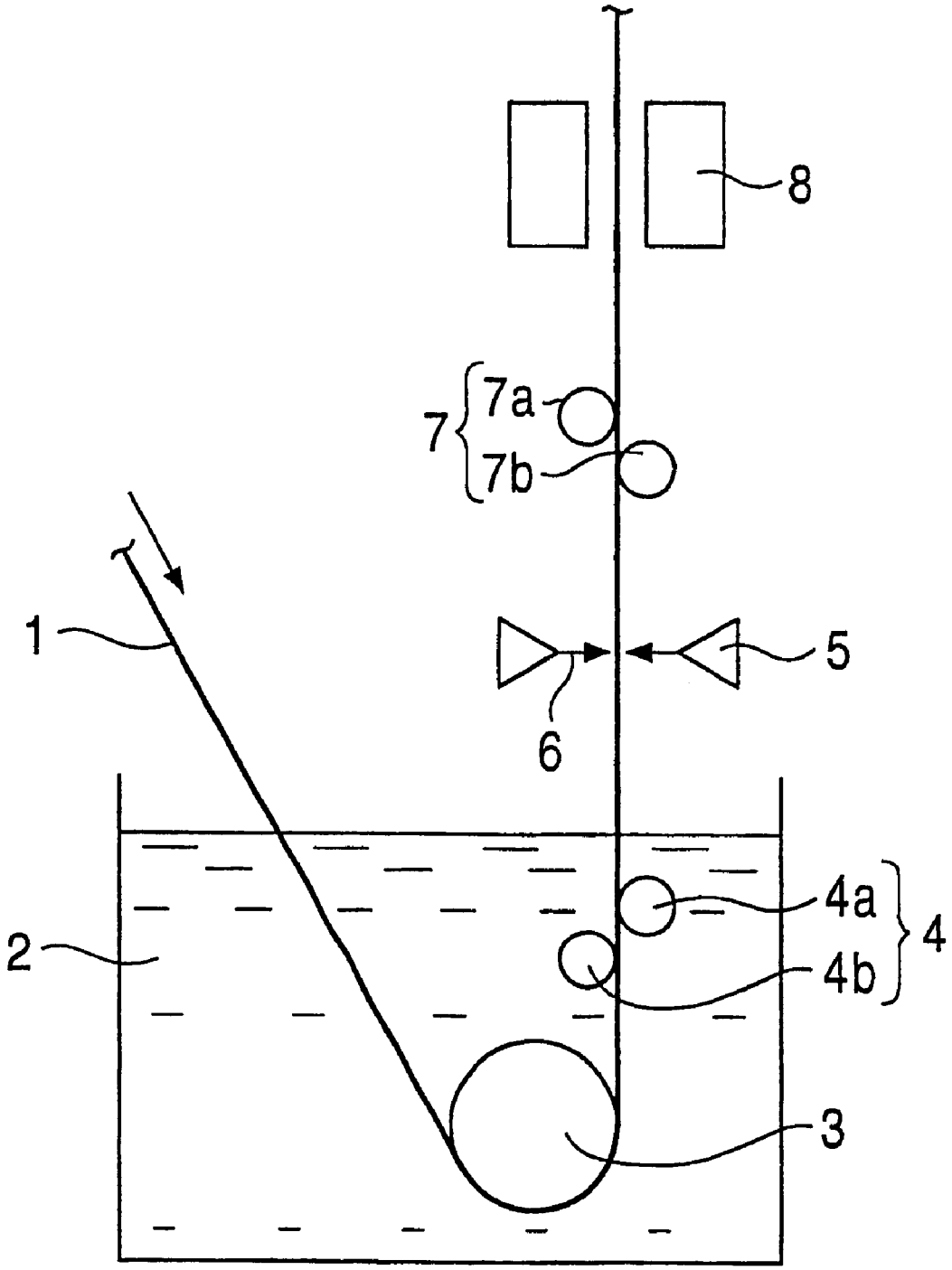
FIG. 2 PRIOR ART
FIG. 2 is a view showing an ordinary continuous hot dip galvanizing apparatus.

The inventors carried out various test operations using the continuous hot dip galvanizing apparatus shown in FIG. 2 and described above. At that time, the support rolls 4 and the touch rolls 7 are arranged as pairs of upper and lower rolls, respectively as shown in FIGS. 1 and 2. In the figures, each upper roll is denoted by "a" and each lower roll is denoted by "b".

A distance L (reference numeral 10, units of mm) was measured between an upper support roll 4*a* and a lower touch roll 7*b* in parallel with the pass line 9 of the steel strip 1. Further, a total amplitude of vibration B (reference numeral 11, units of mm) of the steel strip 1 was measured by measuring with a range finder distances between the surfaces of the steel strip 1 and the front edges of the wiping nozzles (hereinafter, simply referred to as nozzles) 5 perpendicular to the pass line 9.

Figure 3:
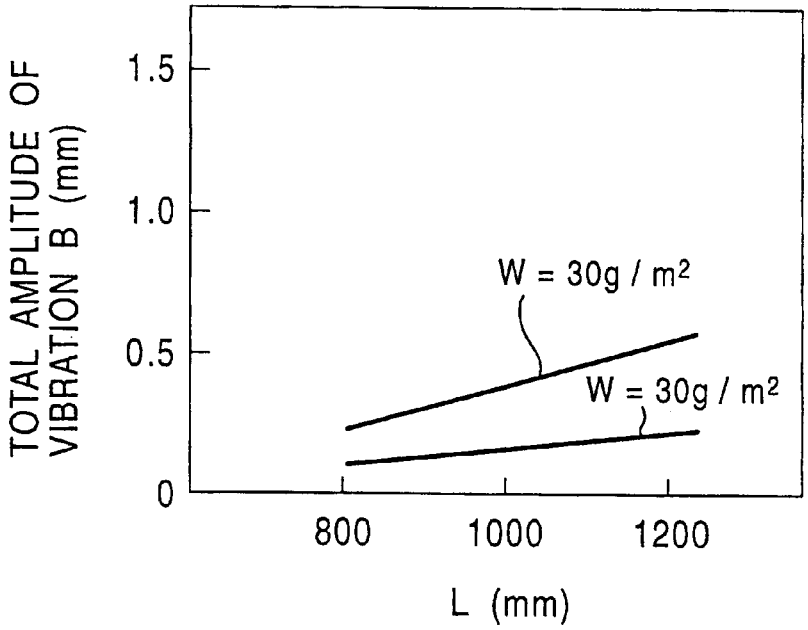
FIG. 3 is a graph showing the relationship between a distance L between an upper support roll in the bath and a lower touch roll outside the bath and a total amplitude of vibration of a steel strip.

First, the inventors examined the influence of the distance L between the upper support roll 4*a* disposed in the bath and the lower touch roll 7*b* on the total amplitude of vibration B of the steel strip 1 when tension of the steel strip 1 was set to 1.5 kgf/mm$^2$ and a line speed thereof was set to 90 m/min. As a result, the relationship shown in FIG. 3 was found. That is, the total amplitude of vibration was reduced by a decrease in the distance L whenever a coating weight per one side was 30 g/m$^2$ and 45 g/m$^2$. The relationship is represented by the following formula (1).

$$B\ L \tag{1}$$

Figure 4:
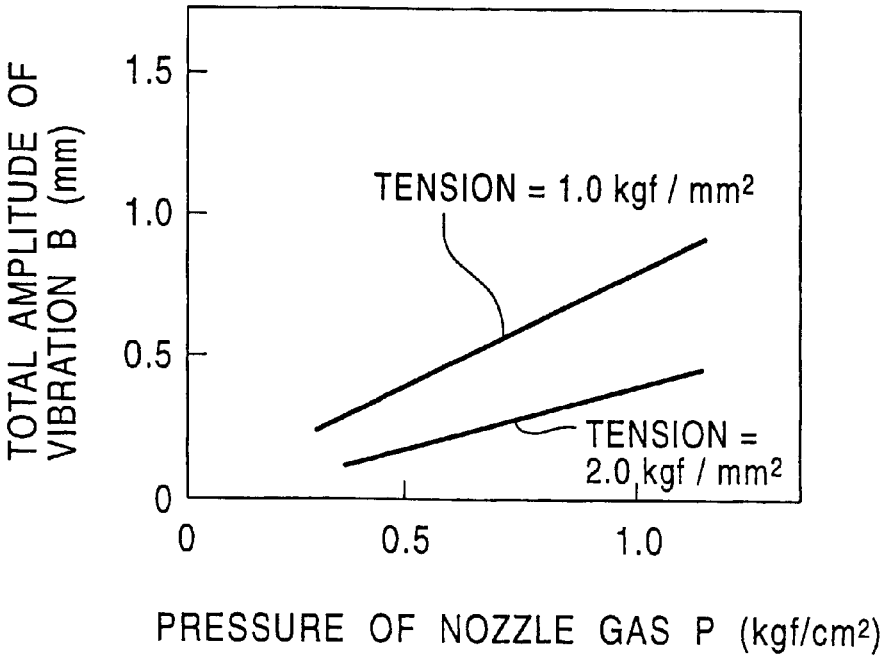
FIG. 4 is a graph showing the relationship between a pressure of a gas ejected from gas wiping nozzles and a total amplitude of vibration of a steel strip.

Furthermore, the inventors paid attention to the pressure p of a wiping gas 6 and the tension T of the steel strip 1 as factors which influenced the total amplitude of vibration B of the steel strip 1 and tested them. FIG. 4 shows the result of measurement of the pressure p and the total amplitude of vibration B of the steel strip when the distance L was set to 1000 mm and the distance between the front edges of the nozzles and the surfaces of the steel strip was set to about 6–8 mm. Furthermore, FIG. 5 shows the result of measurement of the total amplitude of vibration B of the steel strip 1 when the tension T was variously changed.

Figure 5:
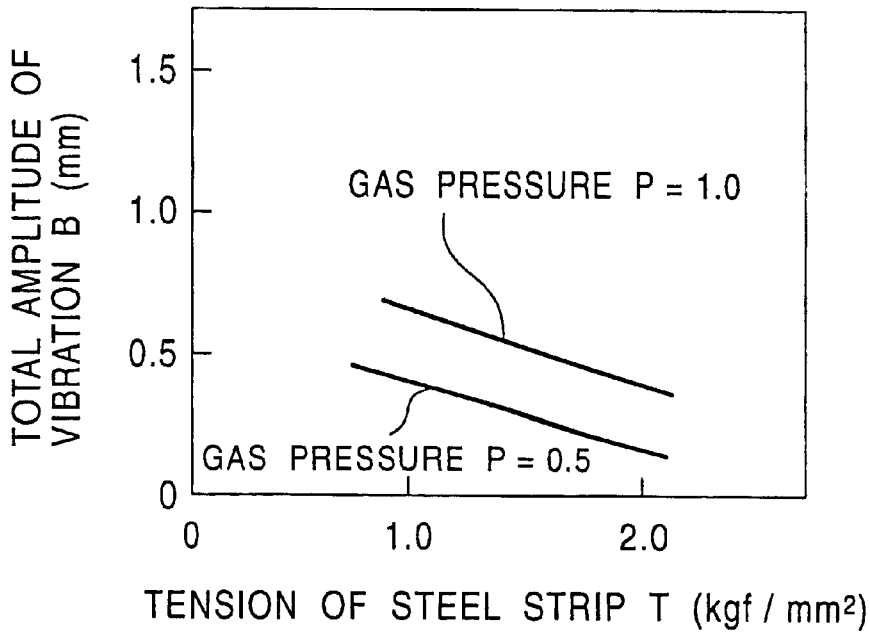
FIG. 5 is a graph showing the relationship between tension of a steel strip and a total amplitude of vibration thereof.

It can be seen from FIGS. 4 and 5 that the total amplitude of vibration B of the steel strip 1 is approximately in proportion to the gas pressure p of the nozzles and approximately in inverse proportion to the tension T of the steel strip 1. This relationship can be expressed simply by a formula (2).

$$B\ P/T \tag{2}$$

Further, the relationship among the gas pressure of the nozzles, the line speed of the steel strip 1 and the coating weight thereof was examined.

Figure 6:
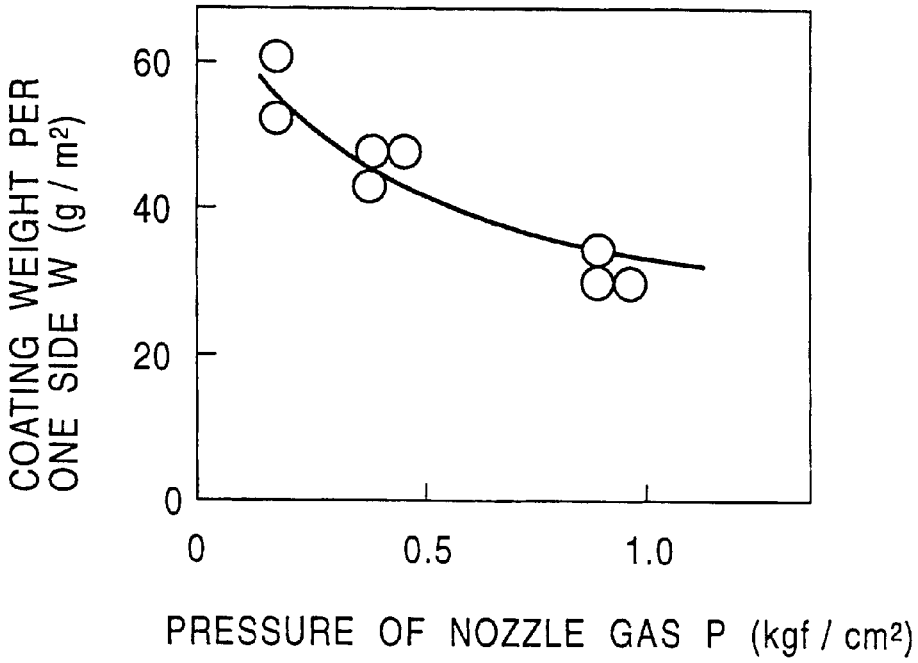
FIG. 6 is a graph showing the relationship between a pressure of a gas ejected from the gas wiping nozzles and a coating weight per one side of a steel strip.
Figure 7:
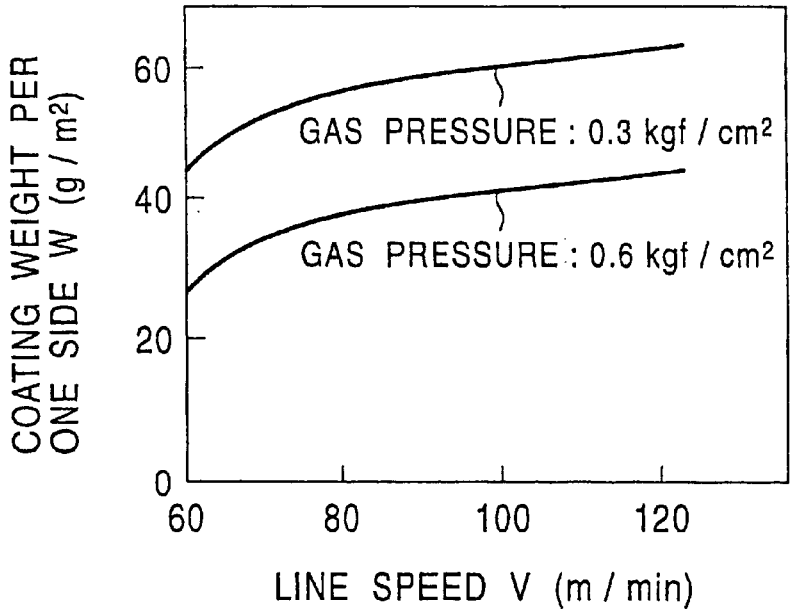
FIG. 7 is a graph showing the relationship between the linear speed of a steel strip and a coating weight per one side thereof.

FIG. 6 shows the relationship between the gas pressure p and the coating weight per one side of the steel strip 1 when the distance between the front edges of the nozzles 5 and the steel strip 1 was set to 6–8 mm and the line speed of the steel strip 1 was set to 90 m/min and the gas pressure p was variously changed. In this case, the coating weight per one side is approximately in proportion to the inverse square root of the pressure P. In contrast, FIG. 7 shows the relationship between the line speed of the steel strip 1 and the coating weight per one side when the distance between the front edges of the nozzles and the steel strip 1 was set to about 6–8 mm, the pressure P was kept constant and the line speed was variously changed. As a result, it can be seen that the coating weight per one side is approximately in proportion to the square root of the line speed of the steel strip 1.

Therefore, the following formula (3) will be established, where the coating weight per one side is represented by W ($g/m^2$), the line speed of the steel strip 1 is represented by V (m/min) and the gas pressure P is represented by P ($kgf/cm^2$).

$$P\ V/W^2 \tag{3}$$

Note that the coating weight per one side W was measured with a coating weight meter and shows the value of the coating weight per one side of the steel strip 1. Further, while the relationship between the line speed of the steel strip 1 and the total amplitude of vibration B thereof was examined with the other conditions kept constant in the test, the total amplitude of vibration B of the steel strip 1 was almost entirely uninfluenced by the line speed.

Thus, the inventors have found that the following formula will be established by arranging the formulas (1), (2), and (3) obtained in the above tests.

$$B\ L\times V/(T\times W^2) \tag{4}$$

Next, the expression $L\times V/(T\times W^2)$, which was referred to as a vibration coefficient, was used to arrange test data.

The inventors thereafter examined the relationship between the total amplitude of vibration B of the steel strip 1 and the variation of the coating weight (evaluation was carried out based on the standard deviation $\sigma(g/m^2)$ of the coating weight). Conventionally, the variation of the coating weight is evaluated on both sides of a steel strip and Japanese Industrial Standards (JIS) also employs so-called "both side guarantee" which evaluates the variation based on both side total coating weight of steel strip. The applicant discloses a both side coating technology in Japanese Unexamined Patent Application Publication No. 10-306356.

In the variation of the both side total coating weight, when the steel strip 1 approaches one of the wiping nozzles 5 by vibration, the coating weight of the side of the steel strip 1 near to the nozzle is reduced, whereas the coating weight of the side thereof far from the nozzle is increased. However, a "both side total coating weight" which is obtained by adding the coating weights of both the sides of the steel strip 1 does not greatly vary in many cases, and thus the standard deviation $\sigma$ is made to a small value. Therefore, the "both side guarantee" is used for convenience in technology, and the deviation of the coating weight must be naturally evaluated based on the coating weight per one side from the view point of coating characteristics, an anti-powdering property and the like. As a natural result, automobile manufactures recently require "one side guarantee" beyond the stipulation of JIS.

Figure 8:
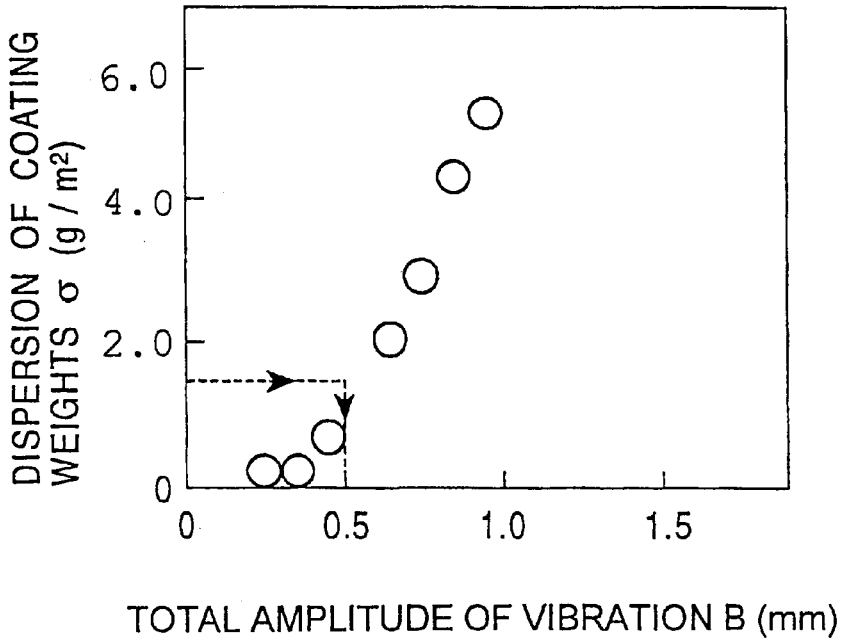
FIG. 8 is a graph showing the relationship between a total amplitude of vibration of a steel strip and variation of a coating weight per one side thereof.

Thus, when the inventors reviewed coating weights used in their company at present on the basis of one side, it was found that the standard deviation $\sigma$ of them was about 2–3 $g/m^2$. Thus, we intended to establish an operating method of coating for obtaining a standard deviation $\sigma$ smaller than the above value, specifically, a standard deviation $\sigma$ of 1.5 $g/m^2$ or less. As a result, the inventors have found that the operating method can be established when a total amplitude of vibration B of a steel strip is set to 0.5 mm or less regardless of the change of the operating conditions in coating as shown in FIG. 8. When many tests were carried out to stably minimize the total amplitude of vibration, it was found that the vibration coefficient should satisfy the following formula.

$$L\times V/(T\times W^2)\leqq 80$$

The present invention has been completed by employing this condition. That is, the steel strip 1 is advanced with the upper limit of the distance L between the upper support roll 4*a* and the lower touch roll 7*b* which is set to satisfy the following formula.

$$L\leqq 80\times T\times W^2/V$$

Furthermore, it is even better to set the upper limit to satisfy $L\leqq 60\times T\times W^2/V$.

Note that the lower limit of the distance L is not particularly critical in the present invention. In an actual coating apparatus, however, the upper support roll 4*a* ordinarily has a diameter of about 250 mmϕ, each support roll has an immersion depth of about 150–200 mm at the center thereof, a height of each wiping nozzle 5 above the bath is about 150–600 mm, and a distance of at least about 300 mm is necessary from each wiping nozzle 5 to the lower touch roll 7*b* above the bath from a view point of the structure of the coating apparatus. As a result, in practice the lower limit of the distance L is expected to be about 600 mm.

Furthermore, it is preferable to move the touch roll 7*b* to actually change the distance L. This is because it is easier to move the lower touch roll 7*b* than to move the upper support roll 4*a* disposed in the bath from the view point of the structure of the coating apparatus.

EXAMPLE

A cold rolled steel strip 1 having a thickness of 0.65–0.90 mm was galvanized by the continuous hot dip galvanizing apparatus shown in FIG. 2.

At that time, operation was carried out using the method of manufacturing a hot dip coated metal strip according to the present invention in which restriction is imposed on the setting of the distance between the above rolls (examples of the present invention) and by a conventional method in which no restriction is imposed thereon (comparative examples). A coating weight was measured on-line while advancing the steel strip 1. The measurement was performed by a fluorescent X-ray coating weight meter (not shown) disposed above the steel strip 1 in travel so as to face downward. Accordingly, the variation $\sigma$ of the measured coating weights represents the variation thereof on one side of the steel strip 1. Furthermore, the pressure of a wiping gas used under the conditions of the respective examples is a value measured on the side of the steel strip 1 where the coating weight was measured.

Figure 9:
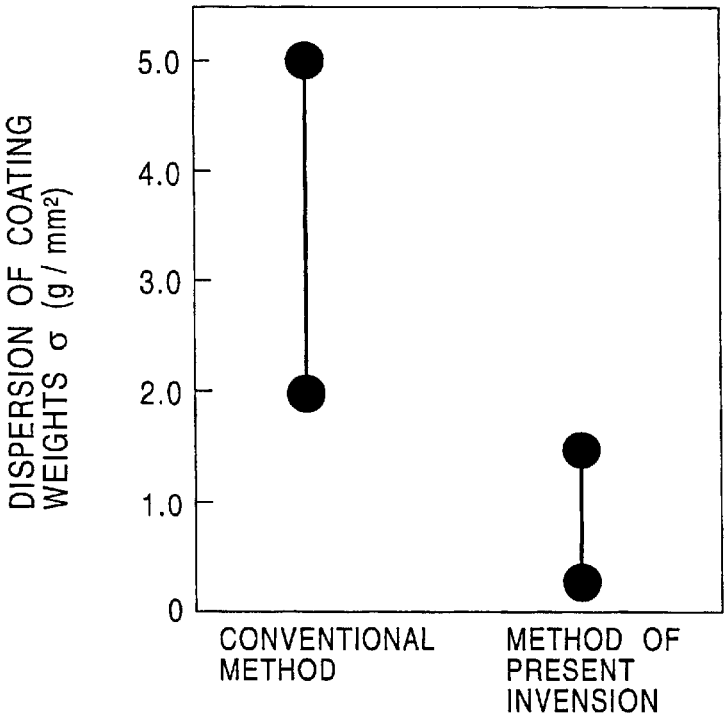
FIG. 9 is a graph comparing variation of a coating weight in a conventional coating method and that in the method of the present invention.
Figure 10:
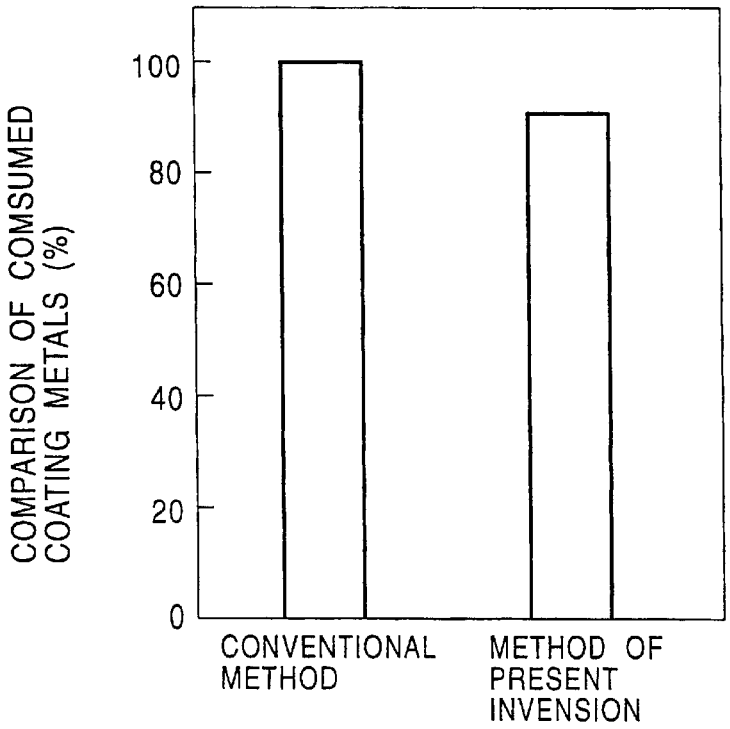
FIG. 10 is a graph comparing an amount of consumption of metal in the conventional coating method and that in the method of the present invention.

Table 1 shows the operating conditions and the result of the measurements collectively. It is apparent from Table 1 that in the specimens Nos. 1–18, which were manufactured by the manufacturing method according to the present invention, the total amplitudes of vibration of the steel strip 1 are 0.5 mm or less because $L\times V/(T\times W^2)\leqq 80$ is satisfied therein. As a result, the variation $\sigma$ of the coating weights is made to 1.5 $g/m^2$ or less in all the examples (refer to FIG. 9). This suggests that a target value of the coating weight can more closely approach a lower limit value in the operation and the consumption of metal can be greatly reduced thereby. FIG. 10 shows the comparison of an amount of coating metal actually consumed in the conventional manufacturing method with that actually consumed in the manufacturing method according to the present invention. When the consumption in the conventional manufacturing method is represented by 100%, the consumption in the manufacturing method of the present invention is about 90%. This means that the consumption of the coating metal can be greatly reduced.

On the other hand, in the specimens Nos. 19–29 manufactured by the conventional manufacturing method, the steel strip 1 has a large total amplitude of vibration and the variation σ of the coating weights thereof is 2.0 g/m$^2$ or more.

of operating conditions other than the above operating conditions and the result of the operation collectively. Note that the anti-powdering property was evaluated by a known method of putting an adhesive tape on the coating layer of a specimen sampled from a hot dip galvanized steel strip under pressure, peeling off the adhesive tape after the specimen was bent 90° and returned to its original state and then measuring an amount of exfoliation of the coated layer with a fluorescent X-ray. That is, the anti-powdering property is represented by the number of counts, which is counted with the X-ray, of zinc contained in the exfoliated coating layer. Usually, when the number of counts is 1500 or less, no defect due to powdering occurs at an actual press

TABLE 1

| | No. | Thickness (mm) | Width (mm) | Line Speed (m/min) | Tension (kg/mm$^2$) | Coating Weight per One Side (g/m$^2$) | Pressure of Wiping Gas (kg/cm$^2$) | L (mm) | (V × L)/(T × W$^2$) | Total Amplitude of Vibration (mm) | Variation of coating weights σ (g/m$^2$) |
|---|---|---|---|---|---|---|---|---|---|---|---|
| Example of the Invention | 1 | 0.7 | 1200 | 60 | 2.0 | 31 | 0.58 | 800 | 25 | 0.19 | 0.25 |
| | 2 | 0.7 | 1200 | 60 | 1.5 | 30 | 0.58 | 800 | 36 | 0.23 | 0.31 |
| | 3 | 0.7 | 1200 | 60 | 1.0 | 43 | 0.28 | 800 | 26 | 0.25 | 0.30 |
| | 4 | 0.7 | 1200 | 57 | 2.0 | 32 | 0.58 | 1000 | 28 | 0.22 | 0.35 |
| | 5 | 0.75 | 1150 | 58 | 1.5 | 30 | 0.58 | 1000 | 43 | 0.30 | 0.55 |
| | 6 | 0.75 | 1150 | 60 | 1.5 | 45 | 0.25 | 1000 | 20 | 0.20 | 0.23 |
| | 7 | 0.75 | 1150 | 60 | 2.0 | 28 | 0.58 | 1200 | 46 | 0.27 | 0.50 |
| | 8 | 0.75 | 1150 | 62 | 1.5 | 33 | 0.58 | 1200 | 46 | 0.33 | 0.60 |
| | 9 | 0.75 | 1150 | 60 | 1.5 | 31 | 0.58 | 1200 | 50 | 0.40 | 1.05 |
| | 10 | 0.65 | 1350 | 90 | 2.0 | 30 | 0.92 | 800 | 16 | 0.26 | 0.25 |
| | 11 | 0.65 | 1350 | 90 | 2.0 | 47 | 0.44 | 800 | 16 | 0.13 | 0.23 |
| | 12 | 0.65 | 1350 | 92 | 2.0 | 57 | 0.23 | 800 | 11 | 0.10 | 0.20 |
| | 13 | 0.85 | 1150 | 122 | 2.0 | 32 | 1.22 | 800 | 48 | 0.35 | 0.51 |
| | 14 | 0.85 | 1150 | 120 | 2.0 | 43 | 0.54 | 800 | 26 | 0.20 | 0.30 |
| | 15 | 0.85 | 1150 | 119 | 2.0 | 58 | 0.32 | 800 | 14 | 0.12 | 0.20 |
| | 16 | 0.85 | 1150 | 120 | 2.0 | 35 | 1.08 | 1200 | 59 | 0.44 | 1.35 |
| | 17 | 0.85 | 1150 | 122 | 2.0 | 45 | 0.55 | 1200 | 36 | 0.25 | 0.51 |
| | 18 | 0.85 | 1150 | 122 | 2.0 | 55 | 0.31 | 1200 | 24 | 0.15 | 0.30 |
| | 19 | 0.85 | 1150 | 120 | 1.5 | 35 | 0.60 | 1000 | 65 | 0.47 | 1.41 |
| | 20 | 0.85 | 1150 | 120 | 1.5 | 35 | 0.60 | 1200 | 78 | 0.50 | 1.50 |
| Comparative Example | 19 | 0.72 | 1300 | 60 | 1.0 | 32 | 0.63 | 1500 | 88 | 0.60 | 1.9 |
| | 20 | 0.7 | 1550 | 60 | 1.0 | 31 | 0.48 | 1500 | 94 | 0.62 | 1.8 |
| | 21 | 0.7 | 1550 | 58 | 1.3 | 30 | 0.59 | 1800 | 89 | 0.55 | 1.8 |
| | 22 | 0.7 | 1550 | 90 | 1.0 | 30 | 0.92 | 1500 | 150 | 1.05 | 4.0 |
| | 23 | 0.7 | 1550 | 90 | 1.1 | 35 | 0.65 | 1500 | 100 | 0.70 | 2.0 |
| | 24 | 0.67 | 1050 | 90 | 1.5 | 30 | 0.88 | 1500 | 100 | 0.65 | 1.8 |
| | 25 | 0.67 | 1050 | 92 | 1.0 | 45 | 0.43 | 200 | 91 | 0.58 | 1.6 |
| | 26 | 0.9 | 1450 | 122 | 1.0 | 32 | 1.13 | 1500 | 178 | 1.35 | 6.0 |
| | 27 | 0.9 | 1450 | 120 | 1.0 | 43 | 0.60 | 1500 | 97 | 0.70 | 2.2 |
| | 28 | 0.9 | 1450 | 120 | 1.5 | 35 | 0.96 | 1300 | 85 | 0.55 | 1.8 |
| | 29 | 0.9 | 1450 | 122 | 1.5 | 30 | 1.22 | 1300 | 117 | 0.70 | 2.1 |

Next, a so-called "hot dip galvanized steel strip" was manufacturing by disposing an alloying furnace 8 above the touch rolls 7 in FIG. 2 and by heating the steel strip 1 on which molten zinc was deposited in the alloying furnace 8 so that the Fe content in the zinc coating layer of the steel strip 1 was made to 8–13 wt %. Then, an anti-powdering property, which was one of important characteristics of quality, of the steel strip 1 was examined. Powdering is a defect wherein a deposited coating layer is exfoliated in a powder state from a portion of a hot dip galvanized steel sheet, which detracts from the intimate contact property of the coating during press forming thereof. When this phenomenon occurs during press forming, the powder of the coating falls between a press die and the steel sheet to thereby cause a defect of irregularity to the steel sheet. Thus, it is desired that no powdering occurs.

Operation was carried out paying attention to the powdering under the conditions of a target coating weight per one side set to 45–55 g/m$^2$, a line speed of the steel strip 1 set to 100 m/min–150 m/min, and a tension of the steel strip 1 set to 1.5 kgf/mm$^2$–2.0 kgf/mm$^2$. Table 2 shows examples forming. However, when the number of counts exceeds 1500, a defect due to powdering often occurs.

Figure 11:
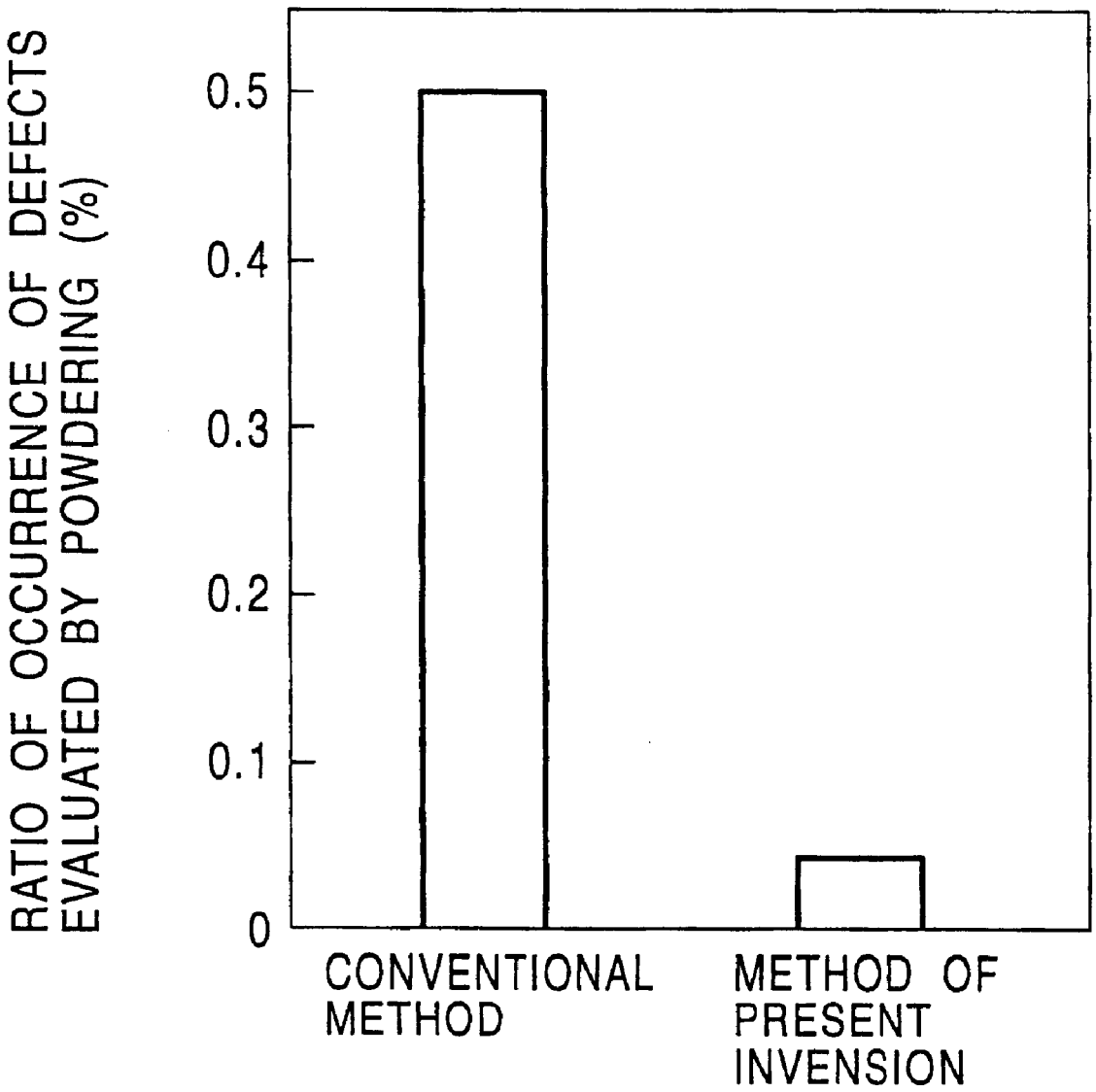
FIG. 11 is a graph comparing a ratio of occurrence of a defective product due to powdering in the conventional coating method and that in the method of the present invention.

It is apparent from Table 2 that since the variation of a coating weight can be greatly reduced according to the method of the present invention, the number of counts is stable at a low value, whereby the hot dip galvanized steel strip 1 excellent in the anti-powdering property can be stably manufactured. In contrast, in the conventional method, there was made a product in which the number of counts was increased and made to 1500 or more at some portions and in which the defect due to powdering was liable arise often when the product was processed. This is because a coating weight greatly varied in the product. FIG. 11 shows a ratio of occurrence of defective products after they were press formed. It is apparent from FIG. 11 that almost no defective products are made by the method of the present invention.

In the above examples, the steel strip was used as a metal strip and the molten zinc was used as molten metal. However, it is needless to say that the present invention is by no means limited thereto and is applicable to other kinds of metal strip and to molten metal other than molten zinc.

TABLE 2

| | Experiment No. | Thickness (mm) | Width (mm) | L (mm) | Total Amplitude of Vibration (mm) | Variation of coating weights σ (g/m²) | Average Density of Fe in Coating Layer (%) | Number of Counts of Powdering (Count/Sec)* |
|---|---|---|---|---|---|---|---|---|
| Example of the Invention | 1 | 0.75 | 1200 | 800 | 0.21 | 0.25 | 11.0 | 400–870 |
| | 2 | 0.75 | 1200 | 800 | 0.24 | 0.31 | 11.3 | 500–950 |
| | 3 | 0.75 | 1200 | 800 | 0.22 | 0.30 | 12.5 | 350–750 |
| | 4 | 0.75 | 1200 | 1000 | 0.40 | 1.05 | 12.7 | 370–1200 |
| | 5 | 0.75 | 1200 | 1000 | 0.29 | 0.55 | 10.9 | 450–850 |
| | 6 | 0.80 | 1550 | 800 | 0.31 | 0.43 | 11.8 | 480–720 |
| | 7 | 0.80 | 1550 | 800 | 0.25 | 0.50 | 11.3 | 500–950 |
| | 8 | 0.80 | 1550 | 800 | 0.35 | 0.60 | 12.2 | 430–830 |
| | 9 | 0.80 | 1550 | 800 | 0.38 | 1.02 | 10.7 | 500–1350 |
| | 10 | 0.80 | 1550 | 800 | 0.27 | 0.23 | 10.8 | 350–730 |
| Comparative Example | 11 | 0.75 | 1250 | 1500 | 0.65 | 2.02 | 11.3 | 430–1950 |
| | 12 | 0.75 | 1250 | 1500 | 0.60 | 1.90 | 10.8 | 520–1750 |
| | 13 | 0.75 | 1250 | 1500 | 0.85 | 3.50 | 11.5 | 480–1550 |
| | 14 | 0.75 | 1250 | 1500 | 1.02 | 4.20 | 12.0 | 550–2500 |
| | 15 | 0.75 | 1250 | 1500 | 0.88 | 4.00 | 11.4 | 450–2550 |
| | 16 | 0.86 | 1500 | 1600 | 0.95 | 3.60 | 11.8 | 580–1950 |
| | 17 | 0.86 | 1500 | 1600 | 1.20 | 5.20 | 10.7 | 550–3200 |
| | 18 | 0.86 | 1500 | 1600 | 1.10 | 4.30 | 10.5 | 650–2900 |
| | 19 | 0.86 | 1500 | 1600 | 0.92 | 3.75 | 11.2 | 800–2300 |
| | 20 | 0.86 | 1500 | 1600 | 0.98 | 3.80 | 12.4 | 600–2050 |

*Showing Maximum and Minimum Measured Values

As described above, a metal strip having molten metal deposited on all surfaces thereof at a uniform coating weight can be manufactured by the present invention. As a result, it is possible to more closely approach a lower target coating weight during a coating operation, whereby the consumption of coating metal can be greatly reduced as compared with a conventional consumption.

What is claimed is:

1. A method of manufacturing a hot dip coated metal strip, comprising the steps of:

dipping a metal strip in a hot dip coating bath to continuously deposit molten metal on surfaces of the metal strip;

conveying the metal strip at a substantially constant speed while supporting said strip with a pair of upper and lower support rolls in the coating bath;

adjusting a coating weight of the molten metal deposited on the surfaces of the metal strip by wiping the molten metal with gases from gas wiping nozzles disposed above a surface of the coating bath; and advancing the metal strip while supporting it with a pair of upper and lower touch rolls disposed outside the coating bath, wherein the metal strip is advanced by setting the distance L between the upper support roll disposed in the coating bath and the lower touch roll disposed outside the coating bath within the range determined by the following formula $$L \leqq 80 \times T \times W^2/V$$

wherein,

L: distance between the upper support roll in the coating bath and the lower touch roll outside the coating bath (mm);

V: line speed of the metal strip (m/min);

T: tension imposed on the metal strip (kgf/mm²); and

W: target coating weight per one side of the metal strip (g/m²).

2. The method according to claim 1, wherein said metal strip is composed of a steel strip and said hot dip coating bath is filled with molten zinc.

3. The method according to claim 1, wherein said metal strip is subjected to an alloying treatment downstream of said upper touch roll.

4. A method of manufacturing a hot dip coated metal strip, comprising the steps of:

conveying a metal strip through a hot dip coating bath to continuously deposit molten metal on surfaces of the metal strip;

supporting said metal strip with a pair of support rolls submerged in the coating bath;

blowing gas on said metal strip as it emerges from said coating bath with gas wiping nozzles disposed above a surface of the coating bath, thereby to adjust a coating weight of molten metal on said strip; and further conveying the metal strip while supporting it with a pair of upper and lower touch rolls disposed outside the coating bath, wherein a distance L between an upper support roll disposed in the coating bath and a lower touch roll disposed outside the coating bath is maintained according to the following formula $$L \leqq 80 \times T \times W^2/V$$

wherein,

L: distance between the upper support roll in the coating bath and the lower touch roll outside the coating bath (mm);

V: line speed of the metal strip (m/min);

T: tension imposed on the metal strip (kgf/mm²); and

W: target coating weight per one side of the metal strip (g/m²).

5. The method according to claim 4, wherein said metal strip is composed of a steel strip and said hot dip coating bath is filled with molten zinc.

6. The method according to claim 4, wherein said metal strip is subjected to an alloying treatment downstream of said upper touch roll.

* * * * *